United States Patent [19]

McLennan et al.

[11] 4,322,100

[45] Mar. 30, 1982

[54] ABUTMENT SWIVEL DOORSTOP

[75] Inventors: Lyall A. McLennan, 2896 Trinity St., Vancouver, British Columbia, V5K 1E9, Canada; John W. Ganjo, Windsor, Canada; Tom Pomarolli, Farmington Hills, Mich.

[73] Assignee: Lyall A. McLennan, Canada

[21] Appl. No.: 99,611

[22] Filed: Dec. 3, 1979

[51] Int. Cl.[3] ..... E05C 5/02

[52] U.S. Cl. ..... 292/67

[58] Field of Search ..... 16/152, 137; 292/297, 292/67, 244

[56] References Cited

U.S. PATENT DOCUMENTS

| | | | |
|---|---|---|---|
| Re. 29,162 | 3/1977 | McLennan | 292/67 |
| 86,658 | 2/1869 | Farmer | 16/152 |
| 2,166,620 | 7/1939 | Bellah | 292/244 X |

*Primary Examiner*—Richard E. Moore

*Attorney, Agent, or Firm*—Robert W. Beach; Douglas E. Winters; Ward Brown

[57] ABSTRACT

Improvements in a doorstop mechanism include a swivel bar mounted on a doorjamb to swing between a position in the path of the door to block its opening and a position retracted out of the path of door-opening movement. The stop bar can be held in door-blocking position by engagement of a rib-and-groove latch. The stop bar can be moved into latch-engaged position by swinging of a keeper to move cooperating cylindrical or edgewise cams relatively which movement shifts the stop bar into latched position in opposition to the force of a latch-releasing spring. The improvements include strengthening the doorstop mechanism and adding members to make it more difficult to break down the door by force such as kicking it and modifications to permit parts to be reversed for use with doors which open to the right away from one (right-hand doors) and which open to the left away from one (left-hand doors).

9 Claims, 19 Drawing Figures

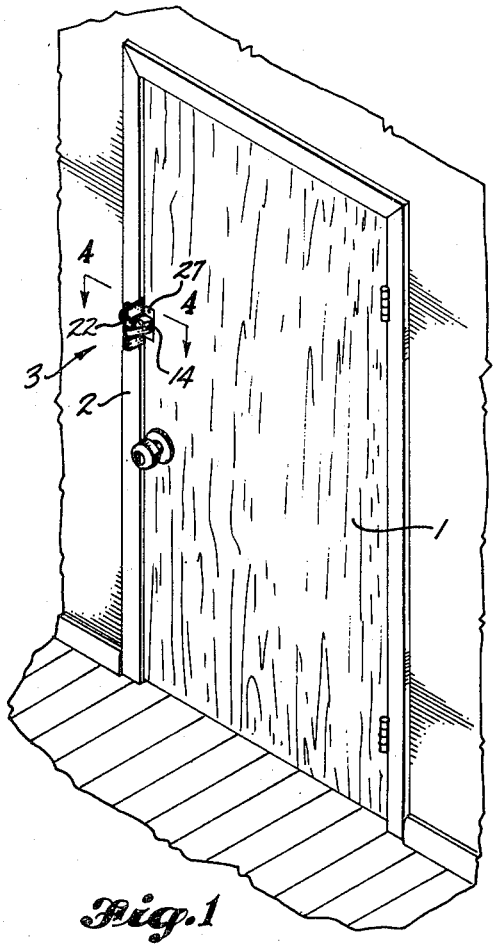
Fig. 1
Fig. 2
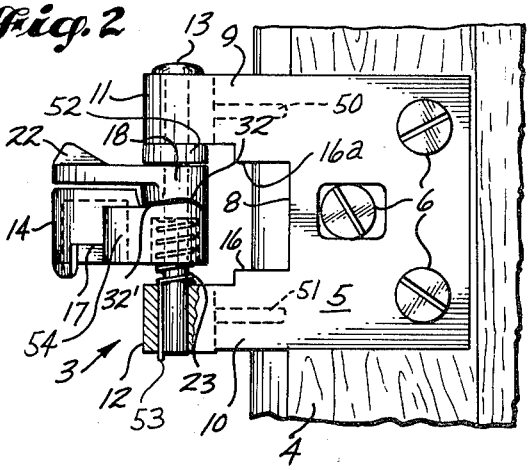
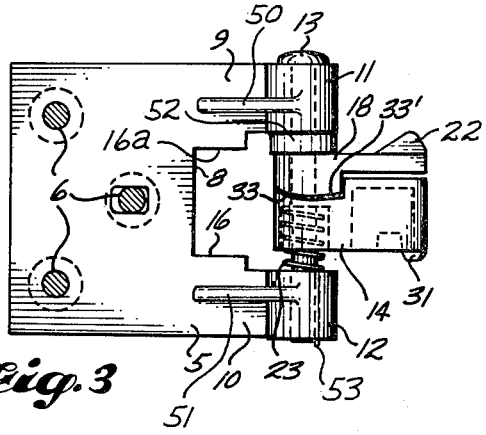
Fig. 3
Fig. 4
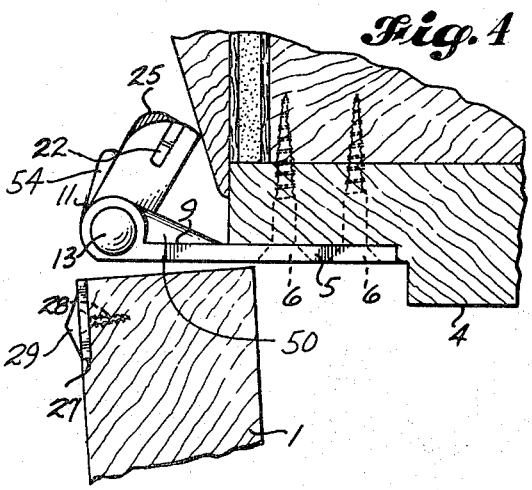
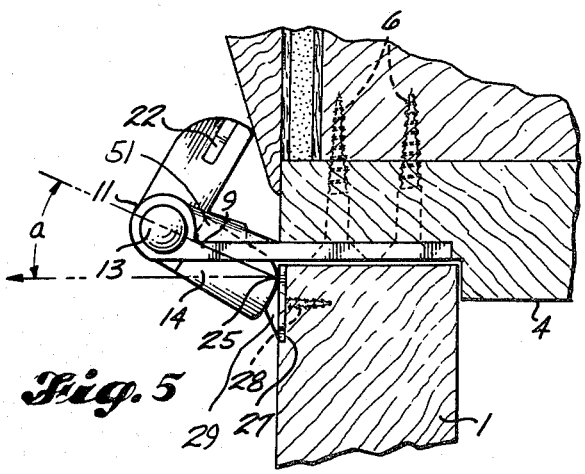
Fig. 5

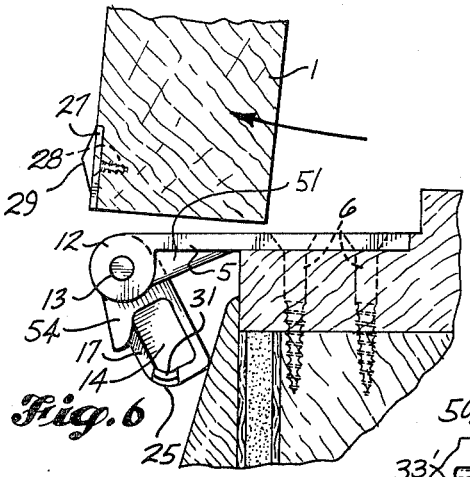
Fig. 6
Fig. 7
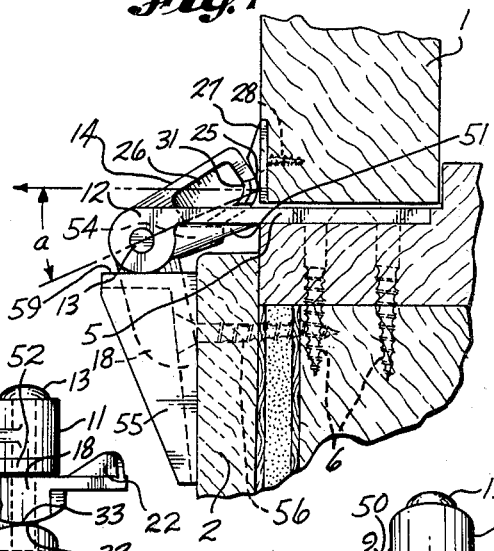
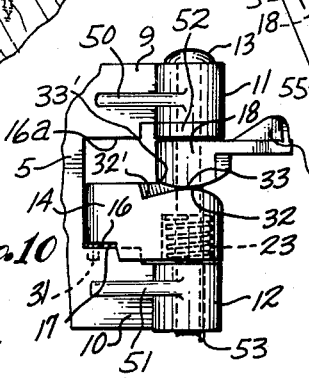
Fig. 10
Fig. 8
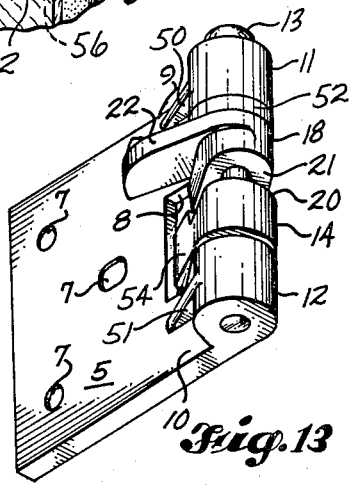
Fig. 13
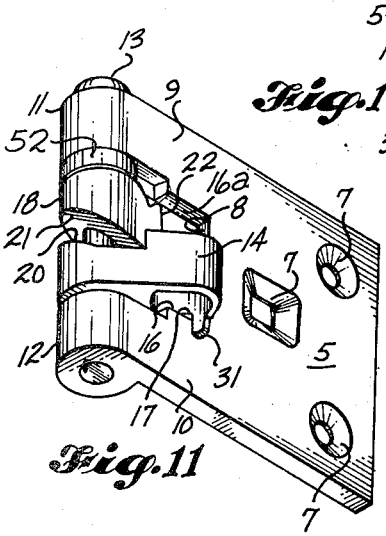
Fig. 11
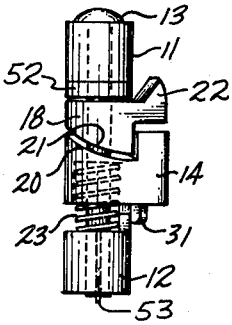
Fig. 9
Fig. 12
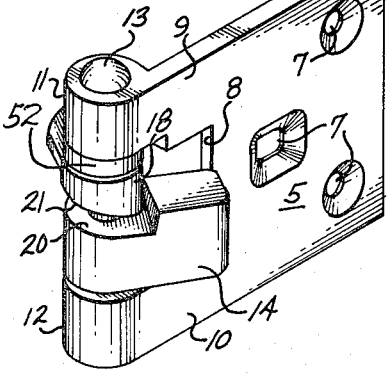
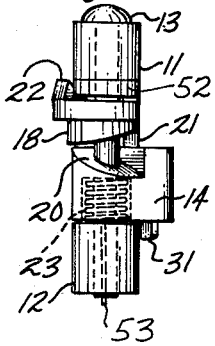
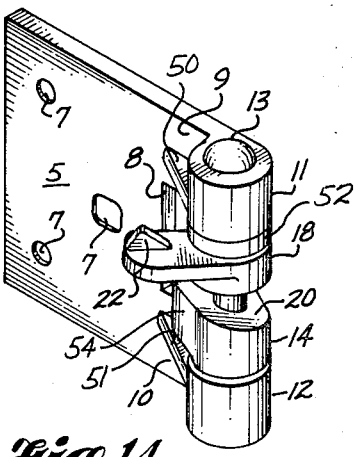
Fig. 14

Fig. 15
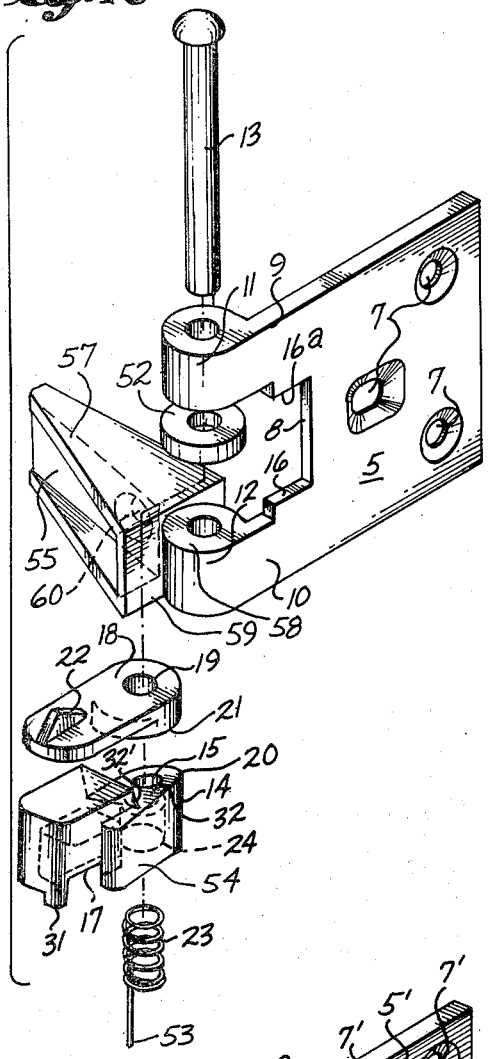
Fig. 16
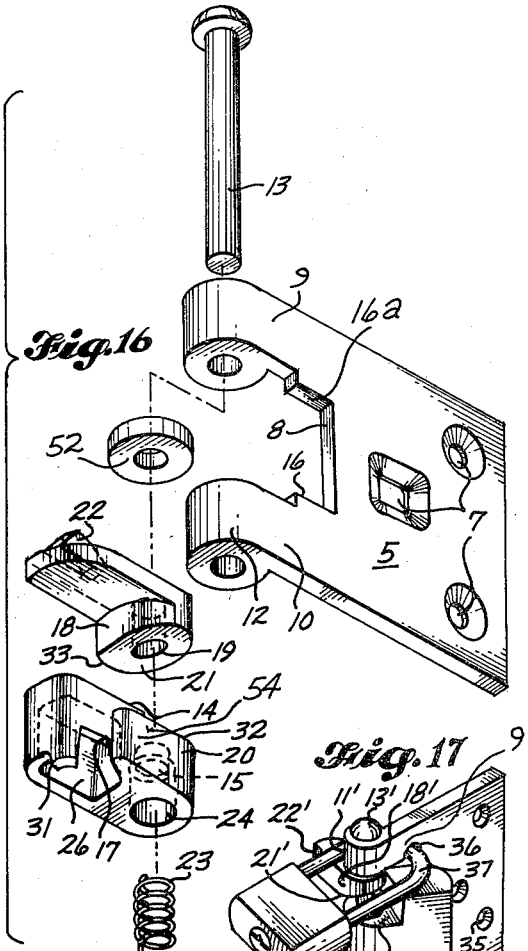
Fig. 17
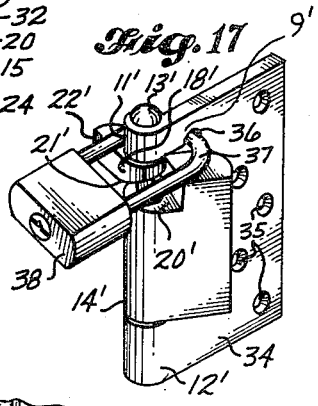
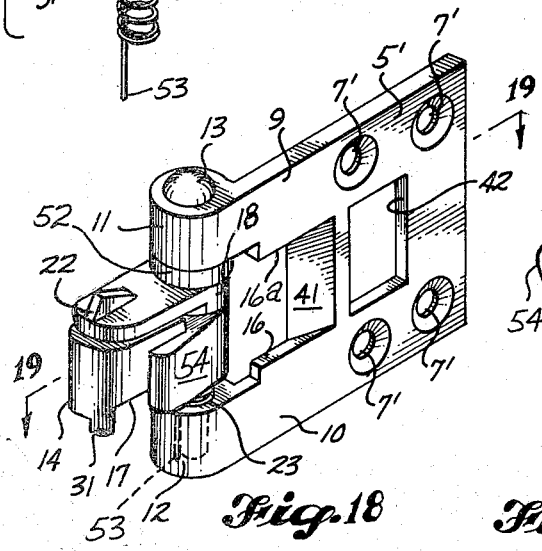
Fig. 18
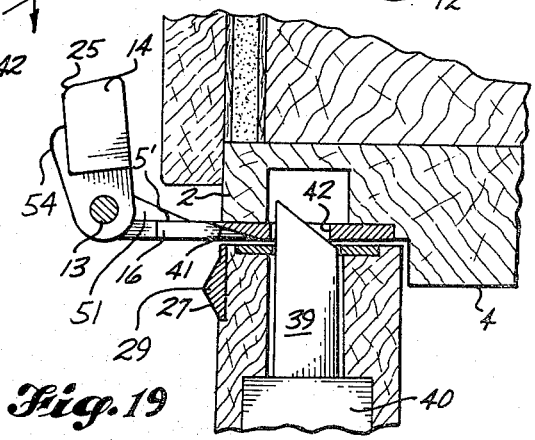
Fig. 19

ABUTMENT SWIVEL DOORSTOP

BACKGROUND OF THE INVENTION

1. Field of the Invention

This application relates to a stop located at the inner side of a door for preventing the opening of such door and is particularly advantageous for use with inwardly swinging doors.

2. Prior Art

The basic doorstop mechanism of the present invention is disclosed in applicant's U.S. Pat. No. Re. 29,162, for Abutment Swivel Doorstop.

SUMMARY OF THE INVENTION

The doorstop mechanism of applicant's reissue U.S. Pat. No. Re. 29,162 successfully met the objects of providing a stop which could be moved into door-locking position quickly and easily;

providing such a doorstop which was small, compact and unobtrusive yet which was strong for its size;

providing such a doorstop which was effective and reliable to prevent the opening of a door and which could be released from only one side of the door;

providing such a doorstop which could be locked so that it could not be opened by an unauthorized person even from the side of the door where the stop was accessible;

providing a stop construction which was simple and had few parts, which was durable, could not jam or otherwise readily become inoperative, yet which was economical to manufacture; and providing such a doorstop which could be installed easily and quickly by an unskilled person.

The foregoing objects were accomplished by a stop mechanism having a stop member turnable about a stop member turning axis parallel to the axis about which a closure swung so that the stop member could swing between a closure-clearing position out of the opening movement path of the closure and a closure-blocking position in the path of closure movement. The stop member was located so that the stop member turning axis was substantially perpendicular to and offset slightly from the opening movement path of the closure and was located so that a line joining the stop member turning axis and a closure-engageable portion of the stop member in closure-blocking position was at an angle of less than 45° to the opening movement path of the stop-engageable portion of the closure. Latch means were engageable between the mount and the stop member for preventing swinging of the stop member relative to the mount out of closure-blocking position.

However, it was discovered that an intruder could break down the door by persistent kicking. Therefore, a principal object of the present invention is to improve such a stop to prevent such breaking in.

A further object is to improve such a doorstop to permit parts to be used with right-hand and left-hand doors, thereby improving the economy of manufacture.

Improvements include (1) making the mechanism mount symmetrical for use with either right-hand or left-hand doors, (2) adding strengthening or reinforcing gussets to the mechanism mount, (3) hardening the pintle, (4) providing a spring with a pigtail to hold the pintle in place without the necessity of staking or upsetting the end of such hardened pintle, (5) strengthening the stop member, (6) adding a ridge to the strike member, and (7) providing a reinforcing bar or block.

BRIEF DESCRIPTION OF THE DRAWINGS

FIG. 1 is a top perspective of a representative door showing a typical installation of an improved left-hand stop mechanism of the present invention installed on a left-hand door.

FIGS. 2 and 3 are side elevations of an improved left-hand stop mechanism viewed from opposite sides showing the door-engageable stop member in door-clearing position.

FIGS. 4 and 5 are plans of the improved stop mechanism, FIG. 4 illustrating the door-engageable stop member in fully retracted door-clearing position and FIG. 5 illustrating such member in door-blocking latched position.

FIGS. 6 and 7 are bottom plans of the improved stop mechanism, FIG. 6 showing the stop member in fully retracted door-clearing position and FIG. 7 showing the stop member latched in door-blocking position.

FIGS. 8 and 9 are edge elevations of the improved stop mechanism, FIG. 8 showing the stop member in door-blocking unlatched position and FIG. 9 showing the stop member in door-blocking latched position.

FIG. 10 is a fragmentary side elevation as viewed from the left of FIG. 9.

FIGS. 11 and 12 are bottom and top perspectives, respectively, of one side, and FIGS. 13 and 14 are bottom and top perspectives, respectively, of the other side of the improved stop mechanism, the stop member in each instance being in door-blocking latched position.

FIGS. 15 and 16 are exploded top and bottom perspectives, respectively, of the improved stop mechanism viewed from the same side.

FIG. 17 is a top perspective of a somewhat modified improved left-hand stop mechanism with the stop member locked in door-locking latched position.

FIG. 18 is a top perspective of another modified improved left-hand stop mechanism with the door-engageable stop member in door-clearing position.

FIG. 19 is a horizontal section through such mechanism taken on line 19—19 of FIG. 18 but with the door-engageable stop member in fully retracted door-clearing position.

DETAILED DESCRIPTION

The improved doorstop of the present invention is most suitable for blocking opening of a closure such as a door 1 mounted in a frame 2 to swing into a building or living space, but the structure could be used for blocking opening of a closure such as a sliding door or window. In each instance the stop mechanism includes a closure-engageable stop member that can be moved between a closure-clearing position out of the path of opening movement of the closure and a closure-blocking position in the path of movement of the portion of the closure engageable by the stop member so as to prevent appreciable opening movement of the closure.

The doorstop mechanism designated generally by the numeral 3 can be attached to the jamb 4 of a doorway, as shown in FIGS. 2 and 3, by securing the mount 5 of such mechanism to the doorjamb by screws 6. Such screws extend through holes 7, preferably three or more as shown in FIG. 15, for example, in the plate portion of the stop mechanism, which plate constitutes the mount 5. Normally such mounting plate portion will be mortised flush into the jamb as shown in FIGS. 4 to 7 inclusive. If desired the stop mechanism could be mounted on the lintel.

From the mounting plate portion 5 an upper ear 9 and a lower ear 10 project in spaced, parallel, coplanar relationship defining an opening 8 therebetween. On the free ends of ears 9 and 10 are bosses 11 and 12, respectively, preferably of cylindrical cross section. A bore through the upper boss 11 and a bore through the lower boss 12 are aligned to receive through them a pintle 13 for mounting swingable stop and keeper members. When stop mechanism 3 is mounted on a doorjamb, the pintle axis is parallel to the door hinge axis. The stop member 14 is a thrust or compression member in the form of a bar having an aperture 15 extending through one end portion, through which aperture the pintle passes. Such stop member shown in FIGS. 2, 3, 8, 9, 14 and 15 in particular, can be swung about the pintle axis between closure-clearing and closure-blocking positions.

While the stop member 14 can be swung from the closure-clearing position of FIGS. 4 and 6 to the closure-blocking position of FIGS. 5 and 7 about the stop member turning axis of pintle 13, it is desirable to hold the stop member positively in the closure-blocking position. Such holding action can be accomplished by providing latch means for preventing the stop member from swinging relative to the mount 5 and ears 9 and 10. Such latch means includes a projection 16 in the form of a shoulder formed on the inner edge of the ear 10 in the opening 8 and located between the mounting plate portion 5 and the boss on ear 10. A socket in the form of a groove 17 in the bottom of the stop member is of a size to embrace the projection 16 reasonably snugly to prevent appreciable swinging to the stop member relative to the ear 10 when such groove is fitted over the projection.

The pintle axis is located a substantial distance from the portion of the stop member engageable by the closure, and is offset slightly from the path of opening movement of the stop-engageable portion of the closure. A line joining the closure-engageable portion of the stop member in a closure-blocking position and the pintle axis is at a small acute angle, such as 20° to 25°, to the path of movement traveled by the stop-engageable portion of the closure toward open position, which angle is designated a in FIGS. 5 and 7. By making the angle a small the stop mechanism can resist a greater pressure exerted on it by the closure.

Since the angle a is less than 45°, the pressure of the closure will exert on the stop member 14 a compressive force toward the pintle 13 greater than the stop member swinging force acting perpendicular to a line joining the pintle axis and the stop-engageable portion of the closure. Also the mount is mounted on the closure frame so that the pintle axis is located farther from the face of the frame than it is to the closure when the closure is in its position closest to the pintle axis.

The pintle 13 is made of very hard and strong material, such as hardened steel, to deter it from being bent by application of a great thrust force on the stop member. Gussets 50 and 51 are located between ears 9 and 10 and bosses 11 and 12, respectfully, to deter bending of the bosses relative to such ears, or breaking of such ears, by force exerted on the ears from pressure of the pintle on such ears caused by thrust exerted by the stop member 14. To further strengthen the doorstop mechanism and make it more difficult to break down the door by kicking, the stop member 14 is reinforced by the addition or protrusion or thickening 54. As best shown in FIG. 7 with the stop member latched in door-blocking position, if the door 1 were forced, a swinging force would be imparted to stop member 14. This force would be resisted by the reinforced protrusion 54 against projection 16.

In order to slide stop member 14 along pintle 13 to engage groove 17 with projection 16, a keeper 18 is provided between the stop member 14 and the ear 9. The keeper has in it a bore 19 through which the pintle 13 extends so that the keeper can turn relative to the stop mechanism mount 5 and its ears 9 and 10. Cam 20 on the stop member and cam 21 on the keeper have adjacent coacting surfaces constituting wedging edgewise or cylinder cams so that relative rotation of the stop member 14 and the keeper 18 between the position shown in FIG. 8 and that of FIG. 9 will spread these members apart.

To permit mount 5 to be reversed for use with right-hand closures and thereby minimize manufacturing costs, the mount 5 includes a projection **16*a* in the form of a shoulder formed on the inner edge of the ear 9. Washer or spacer 52 maintains correct axial positioning of the stop member 14 and keeper 18**.

To facilitate turning of the keeper 18, an upwardly projecting finger-engageable tab or handle 22 projects upwardly from the radial portion of the keeper. The stop member 14 is pressed toward the keeper 18 by a helical compression spring 23 circling the pintle 13. One end of the spring is fitted in counterbore 24 of the aperture 15 through which the pintle 13 passes. The other end of the spring 23 is a pigtail 53 which is friction fitted by pintle 13 into the bore of boss 12. This friction fit holds the pintle in place during an attempted forced entry without the necessity of staking or upsetting the unheaded end of the hard pintle. When the groove 17 is engaged with the projection 16 (or **16*a* for a right-hand closure), the end portion 25 of the keeper bar 14 will be closest to the door 1 and, in fact, next to the closed door. Lug 31 projecting below the lower edge of the side of stop member 14 opposite groove 17 is engageable with projection 16 to limit the swung position of such stop member, as shown in FIGS. 7, 8 and 11. A lightening cavity 26** is provided in the stop bar.

To prevent the door 1 being marred by its face striking or being pressed against the blocking surface 25 of the stop member 14, a faceplate 27 can be mounted on the face of the door at the location engageable by the stop member surface 25. Such faceplate 27 is secured to the door face by one or more screws 28, as shown in FIGS. 4 to 7 inclusive, and preferably such faceplate is recessed by being mortised flush with the adjacent surface of the door as also shown in those figures. As shown in FIGS. 4 and 5, faceplate 27 includes a wedge-shaped or crested projection 29 which is abutable by the end portion 25 of the stop member 14 when the door 1 is shut and the stop member is in door-blocking latched position. The advantage of the projection being wedge-shaped over a flat member is that if the door were forced or kicked the transmitted force would be more perpendicular to the end portion 25 of stop member 14, thereby minimizing the force tending to swing the stop member about the pintle axis and unlock the stop mechanism.

In the manner described below, the stop member 14 and keeper 18 can occupy three principal positions namely, closure-clearing position, unlatched closure-blocking position and latched closure-blocking position.

The closure-clearing position is illustrated in FIGS. 4 and 6 in which keeper 18 and stop member 14 are in registration. These members can be swung conjointly through an intermediate position shown in FIGS. 2 and 3 into the unlatched closure-blocking position shown in FIG. 8. The handle 22 can be swung relative to stop member 14 through the intermediate position of FIGS. 9 and 10 into the position shown in FIGS. 5, 7 and 11 through 14 to latch the stop member in closure-blocking position.

By adding gussets 50 and 51 to reinforce the ears 9 and 10, and providing a very hard and strong pintle 13, the doorstop mechanism is strengthened to make it more difficult to break down the door by forcing or kicking it. A maleable pintle and unreinforced mount would tend to bend and possibly break under the force of repeated blows or kicking.

To further strengthen and reinforce the doorstop mechanism against bending of the lower boss 10 under force, a reinforcing block 55 may be mounted to the frame 2 by one or more screws 56 which extend through holes 60 as shown in FIGS. 7 and 15. The reinforcing block is mounted such that its upper surface 57 is at essentially the same level as the upper surface 58 of boss 12 and the vertical surface 59 abuts boss 12 as shown in FIG. 7. Therefore, the doorstop mechanism is rendered more force resistant by the improvement of the present invention.

While the stop mechanism can be mounted with either edge up depending on which direction the door 1 swings relative to the frame 2, it is preferred that the stop mechanism be mounted so that the keeper 18 is above the stop member 14 as shown in FIGS. 2, 3 and 8 to 13. If the stop mechanism is mounted so that the keeper 18 is below the stop member 14, the reinforcing bar 55 should be mounted adjacent to the boss closest to the stop member. Otherwise the reinforcing bar would interfere with the projecting finger-engageable tab of the keeper or handle 22.

When the keeper 18 is in registration with the stop member 14, as shown in FIGS. 2, 3 and 8, irrespective of the swung positions of these two members relative to the mount 5 and ears 9 and 10, the edgewise cam surfaces 20 and 21 will be contiguous as shown in these figures and stop member 14 will be forced as far as possible away from the ear 10 by the spring 23. Such spring presses the stop bar 14 against the keeper 18 and thereby presses the keeper against the boss 11 of the opposite ear 9, as also shown in these figures.

When the stop member 14 is held by spring 23 in such spaced relationship relative to the boss 12 of ear 10, the grooved portion of the stop member will clear the projection 16 so that the stop member and keeper 18 can be swung freely and conjointly about the axis of pintle 13 between the closure-clearing limit position shown in FIGS. 4 and 6 and the unlatched closure-blocking limit position shown in FIG. 8. These members cannot swing conjointly farther into the opening 8 because lug 31 will engage the side of the shoulder 16, as shown in FIGS. 7, 8 and 11. These swinging parts are shown in an intermediate position in FIGS. 2 and 3. The pressure of spring 23 will tend to maintain the stop member 14 and the keeper 18 in registration.

If the stop member 14 and keeper 18 are swung conjointly into the closure-blocking position shown in FIG. 8 when the door 1 is closed, force can be applied to the handle 22 of keeper 18 to swing it toward the position shown in FIGS. 9 and 10 while the stop member is held manually in the swung position shown in FIGS. 5, 7, 8, 9, 10, 11 and 12. The wedging coaction of the edgewise cam surfaces 20 and 21 resulting from turning of keeper 18 from the position shown in FIG. 8 to the position shown in FIGS. 9 and 10 relative to the stop member 14 will spread the stop member and keeper. Since movement of the keeper 18 axially of pintle 13 is prevented by engagement of such keeper with the spacer 52 and the boss 11, the spreading of the stop member and keeper will result in the stop member being moved toward the ear 10 and its boss 12, as shown in FIG. 9.

By such movement of the stop member 14 axially of pintle 13, the groove 17 of the stop member will be pressed over the projection 16 of ear 10 to the position shown best in FIGS. 7 and 11. As soon as the stop member 14 is thus moved axially sufficiently so that the projection 16 enters at least partially into the groove 17 so as to prevent the stop member from swinging out of closure-blocking position, such stop member need no longer be held manually against swinging while turning of keeper 18 is continued by exerting force on handle 22.

Both cam surfaces 20 and 21 are semicircular inclined wedging surfaces. Cam surface 20 on stop member 14 is upwardly inclined from one side to the other side as shown in FIGS. 8 and 9. A crown 32 shown in FIG. 10 constitutes the highest portion of the cam surface which continues beyond such crown a short distance as a recess 32'. As seen in FIGS. 3 and 10, cam surface 21 on the keeper 18 has an initial recess 33', merging with a downwardly projecting crown 33, which in turn merges with an upwardly-inclined surface. Such components combine to form the end of such cam. When the keeper 18 and stop member 14 are in the aligned oppositely-projecting relationship shown in FIGS. 9 and 10, the crowns 32 and 33 are in engagement as shown in FIG. 10 and the stop member and keeper have been spread apart to their maximum extent. As keeper 18 is turned farther toward the position of FIGS. 5, 7, 13 and 14, the crowns 32 and 33 move relatively past the dead center established by their mutual engagement, and the spring 23 moves stop member 14 slightly toward keeper 18 and slightly away from boss 12 so that recesses 32' and 33' are engaged. Consequently, reverse relative rotation of the cam is deterred and the keeper tends to be maintained in such position beyond dead center to hold stop member 14 securely latched in the closure-blocking position shown in FIGS. 5, 7 and 11 to 14 for engagement by the faceplate 27 on the door. If an attempt is made to open the door, such engagement will prevent further opening movement of the door and pressure on the door will produce a compression force in stop member 14 through wedge-shaped projection 29 of faceplate 27.

When it is desired to shift the stop member 14 from the closure-blocking position of FIGS. 5, 7 and 11 to 14 to the closure-clearing position shown in FIGS. 4 and 6, it is necessary first to swing the keeper handle 22 from the position of FIGS. 5, 7 and 11 to 14, fully toward the door through the position of FIGS. 9 and 10 into the position of FIG. 8. While the keeper handle 22 is being swung from the position of FIG. 9 to the position of FIG. 8, the spring 23 will shift the stop member 14 progressively axially along pintle 13 from the position of FIG. 9 toward the position of FIG. 8.

When the keeper 18 has been brought into registration with the stop member 14 as shown in FIG. 8, such stop member will have been shifted axially of pintle 13 sufficiently so that groove 17 will clear the projection 16. Next the keeper and stop member can be swung conjointly in the opposite direction away from the door from the position of FIG. 8 to the closure-clearing position of FIGS. 2 and 3 or even farther to the closure-clearing position of FIGS. 4 and 6. The door 1 can then be opened freely without interference by the stop member.

A double swinging action is also required to shift the stop member from the closure-clearing position to the closure-blocking position. The keeper and stop member are swung conjointly toward the door to the position of FIG. 8 and then the keeper alone is swung away from the door into the position of FIGS. 5, 7 and 11 to 14.

Instead of relying on the swiveled keeper alone to maintain the stop member in closure-blocking position relative to the stop mechanism mount such stop member can be locked positively in its closure-blocking position if desired. In FIG. 17 a heavy-duty swivel doorstop mechanism is illustrated which has parts corresponding to the parts of the doorstop mechanism described above but which parts are larger and stronger. Corresponding parts in FIG. 17 are numbered the same as in FIGS. 1 to 16, but primed. In this structure the base 34 can be secured to a doorjamb by screws or bolts passing through holes 35. Ears project in spaced relationship from the base 34 and have bosses 11' and 12' which are bored to receive the pintle 13'. Such pintle extends through a bore in the stop member 14'.

The adjacent portions of the stop member 14' and a keeper 18' have cooperating edgewise or cylinder cams 20' and 21' which coact during relative turning of the stop member and keeper to spread these parts. Turning of the keeper 18' relative to the stop member 14' is effected by swinging handle 22' integral with the keeper. It is not necessary, either in the structure of this stop mechanism or in that described in connection with FIGS. 2 through 16, to provide a spring for urging in the stop bar away from the ear 10 or 10' to disengage the latch groove from a latch edge. Instead the stop member can be shifted manually, axially of the pintle into unlatched position. The spring, however, provides a more convenient operation for shifting the stop member from closure-blocking to closure-clearing position.

Instead of or in addition to relying on the keeper 18' to hold the stop member 14' in a position such that its latch groove is in latching engagement with the latch edge, an eye can be provided between the stop member and the ear 9' into which a spacer member can be inserted to limit movement of the stop member 14' axially of the pintle 13'. In FIG. 17 the eye is shown as being formed by an arcuate notch 36 in the edge of ear 9' adjacent to the stop member 14'. The shackle 37 of a padlock 38 is shown as having been inserted through such eye to serve as the spacer member for limiting axial movement of the stop member 14'. By application of a padlock in this manner, the stop mechanism is held positively in closure-blocking position until the padlock is removed.

In the alternative construction shown in FIGS. 18 and 19 most of the components can be identical with those described in connection with FIGS. 2 to 16 inclusive and are numbered the same. Modified parts are numbered similar to FIGS. 1 to 16, but primed. In this instance, the mount 5' differs from the mount of the stop mechanisms described above in that such mount includes features of a conventional strike for a door lock. Instead of the doorstop mechanism being entirely separate from the door lock, the mount of the stop mechanism is integrated with the strike of the door lock to reduce the amount of hardware and thus installation labor in new construction.

In order to provide a stop member and keeper of adequate strength, the width of the opening between the projection 16 and the projection **16*a* is likely to be greater than the width of the bolt 39 of lock 40. Consequently, the edge of the opening parallel to and remote from pintle 13 is inclined to form a ramp 41 along which the end of bolt 39 can slide to wedge the bolt out of the opening between projections 16 and 16*a*. At the side of the ramp 41 remote from pintle 13 is another opening 42 into which the end of the bolt 39 can snap as the door is closed to hold the door in the position shown in FIG. 19. The mount 5' is held in proper position on the doorjamb by screws or bolts extending through apertures 7' in the mount. When the stop member is in closure-clearing position such as shown in FIG. 18 or FIG. 19, bolt 39 can pass stop mechanism 3. When the door is closed, the stop member can be swung between closure-blocking and closure-clearing positions in the manner described above in connection with FIGS. 2 to 16 and will block opening of the door by engagement of the wedge-shaped projection 29 of faceplate 27 with the stop member 14** in the same manner as described above.

If reliance were placed on the lock 40 alone to secure a door, a thin stiff sheet could be inserted between the edge of the door 1 and the doorjamb 4 from the right side as seen in FIG. 19 to wedge the inclined end of bolt 39 out of the window 42 of the mount 5'. However, with the stop mechanism of the present invention, even if such a sheet were forced on through the space between the door edge and the jamb into engagement with the stop member 14, such stop member could not be dislodged because of the latching engagement between its groove 17 and the projection 16. Such engagement is maintained by the keeper 18 being in its position past dead center, as shown in FIGS. 11 to 14, inclusive, or by the interposition of some other type of spacer between the stop member 14 and the ear 9, such as the shackle of a padlock, as discussed in connection with FIG. 17.

We claim:

1. In abutment stop mechanism for blocking opening movement of a closure swingable about an upright axis including a pintle, a mounting plate separate from the closure, mounted independently of the closure at a location adjacent to the closure when the closure is in closed position and having spaced ears defining an opening therebetween and providing sockets for the pintle, a stop member having a portion received in the opening between the spaced ears and having a bore receiving the pintle when fitted in the pintle sockets for turning of the stop member between a closure-blocking position obstructing a predetermined opening-movement path of the closure and a closure-clearing position out of the opening-movement path of the closure, in which closure-blocking position of the stop member a closure-engageable portion of the stop member, located a substantial distance from the pintle, is engageable by a stop-engageable portion of the closure to limit its movement along a predetermined opening-movement path, latch means for preventing swinging of the stop member out of closure-blocking position, and spring means urging the stop member lengthwise of the pintle in the direction to disengage the latch means, the improvement comprising reinforcing means including:

(a) a gusset bridging between the mounting plate and each of the spaced ears and reinforcing the connection between the mounting plate and the spaced ears to deter deformation of the ears by application of force on the stop member when in closure-blocking position;

(b) a faceplate mountable on the closure adjacent to the closure-engageable portion of the stop member when the closure is in closed position and the stop member is in closure-blocking position, said faceplate having a wedge-shaped projection with one face substantially parallel to the closure-engageable portion of the stop member when the closure is in closed position and the stop member is in closure-blocking position for transmitting a compressive force toward the pintle greater than the stop member swinging force transmitted during an attempt to force opening movement of the closure;

(c) a reinforcing block mountable adjacent to one of the mounting plate ears at the side thereof opposite the closure for backing abutment with such ear when force is applied to the stop member in closure-blocking position during an attempt to force opening movement of the closure;

(d) the pintle being of hard strong material for deterring deformation of the pintle and for preventing forcing of the closure open by force on the stop member when in closure-blocking position; and (e) the spring means including a pigtail friction fitted between the pindle and one of the mounting plate pintle sockets for preventing inadvertent removal of the pintle from such socket.

2. The mechanism defined in claim 1, in which the latch means includes the stop member having a latch groove located for engagement with a first latch projection carried by the mounting plate and in which the mounting plate includes a second latch projection carried by the mounting plate spaced from the first latch projection axially of the stop member turning axis and engageable by the stop member latch groove for stop member latching when the stop member is in inverted position relative to the stop member turning axis for enabling the stop mechanism to be adapted for selective use with right-hand and left-hand closures.

3. In abutment stop mechanism for blocking opening movement of a closure swingable about an upright axis including a pintle, a mounting plate separate from the closure, mounted independently of the closure at a location adjacent to the closure when the closure is in closed position and having spaced ears defining an opening therebetween and providing sockets for the pintle, a stop member having a portion received in the opening between the spaced ears and having a bore receiving the pintle when fitted in the pintle sockets for turning of the stop member between a closure-blocking position obstructing a predetermined opening-movement path of the closure and a closure-clearing position out of the opening-movement path of the closure, in which closure-blocking position of the stop member a closure-engageable portion of the stop member, located a substantial distance from the pintle, is engageable by a stop-engageable portion of the closure to limit its movement along a predetermined opening-movement path, the improvement comprising a faceplate mountable on the closure adjacent to the closure-engageable portion of the stop member when the closure is in closed position and the stop member is in closure-blocking position, said faceplate including a wedge-shaped projection having one face substantially parallel to the closure-engageable portion of the stop member when the closure is in closed position and the stop member is in closure-blocking position for transmitting a compressive force toward the pintle greater than the stop member swinging force transmitted during an attempt to force opening movement of the closure.

4. In abutment stop mechanism for blocking opening movement of a closure swingable about an upright axis including a pintle, a mounting plate separate from the closure, mounted independently of the closure at a location adjacent to the closure when the closure is in closed position and having spaced ears defining an opening therebetween and providing sockets for the pintle, a stop member having a portion received in the opening between the spaced ears and having a bore receiving the pintle when fitted in the pintle sockets for turning of the stop member between a closure-blocking position obstructing a predetermined opening-movement path of the closure and a closure-clearing position out of the opening-movement path of the closure, in which closure-blocking position of the stop member a closure-engageable portion of the stop member, located a substantial distance from the pintle, is engageable by a stop-engageable portion of the closure to limit its movement along a predetermined opening-movement path, the improvement comprising a reinforcing block mountable adjacent to one of the mounting plate ears at the side thereof opposite the closure for backing abutment with such ear when force is applied to the stop member in closure-blocking position during an attempt to force opening movement of the closure.

5. In abutment stop mechanism for blocking opening movement of a closure swingable about an upright axis including a pintle, a mounting plate separate from the closure, mounted independently of the closure at a location adjacent to the closure when the closure is in closed position and having spaced ears defining an opening therebetween and providing sockets for the pintle, a stop member having a portion received in the opening between the spaced ears and having a bore receiving the pintle when fitted in the pintle sockets for turning of the stop member between a closure-blocking position obstructing a predetermined opening-movement path of the closure and a closure-clearing position out of the opening-movement path of the closure, in which closure-blocking position of the stop member a closure-engageable portion of the stop member, located a substantial distance from the pintle, is engageable by a stop-engageable portion of the closure to limit its movement along a predetermined opening-movement path, latch means for preventing swinging of the stop member out of closure-blocking position relative to the mounting plate, and spring means urging the stop member to move relative to the mounting plate in the direction to disengage the latch means, the improvement comprising the spring means including a pigtail friction fitted between the pintle and one of the mounting plate sockets for preventing inadvertent removal of the pintle from such socket.

6. The mechanism defined in claim 5, in which the pintle is constructed of hard strong material for deterring misalignment of the stop member turning axis and for preventing forcing of the closure open by force on the stop member when in closure-blocking position.

7. In abutment stop mechanism for blocking opening movement of a closure swingable about an upright axis including a pintle, a mounting plate separate from the closure, mounted independently of the closure at a location adjacent to the closure when the closure is in closed position and having spaced ears defining an opening therebetween and providing sockets for the pintle and a latch projection projecting into such opening adjacent to one of the ears, and a stop member having a portion received in the opening between the spaced ears and having a bore receiving the pintle when fitted in the pintle sockets for turning of the stop member between a closure-blocking position obstructing a predetermined opening-movement path of the closure and a closure-clearing position out of the opening-movement path of the closure, in which closure-blocking position of the stop member a closure-engageable portion of the stop member, located a substantial distance from the pintle, is engageable by a stop-engageable portion of the closure to limit its movement along a predetermined opening-movement path, the stop member having a latch groove in one side for engagement with the mounting plate latch projection by movement of the stop member lengthwise of the pintle when the stop member is in closure-blocking position for preventing swinging of the stop member out of closure-blocking position, the improvement comprising the mounting plate having a second latch projection spaced from the first latch projection axially of the stop member turning axis, projecting into the opening between the spaced ears adjacent to the other of such ears and engageable by the stop member latch groove for stop member latching when the stop member is in inverted position relative to the opening for enabling the stop mechanism to be adapted for selective use with right-hand and left-hand closures.

8. The mechanism defined in claim 7, including spacing means interposed between the stop member and the upper one of the ears for maintaining axial positioning of the stop member relative to the mounting plate.

9. In abutment stop mechanism for blocking opening movement of a closure swingable about an upright axis including a pintle, a mounting plate separate from the closure, mounted independently of the closure at a location adjacent to the closure when the closure is in closed position and having spaced ears defining an opening therebetween and providing sockets for the pintle, a stop member having a portion received in the opening between the spaced ears and having a bore receiving the pintle when fitted in the pintle sockets for turning of the stop member between a closure-blocking position obstructing a predetermined opening-movement path of the closure and a closure-clearing position out of the opening-movement path of the closure, in which closure-blocking position of the stop member a closure-engageable portion of the stop member, located a substantial distance from the pintle, is engageable by a stop-engageable portion of the closure to limit its movement along a predetermined opening-movement path, latch means for preventing swinging of the stop member out of closure-blocking position, and spring means urging the stop member lengthwise of the pintle in the direction to disengage the latch means, the improvement comprising reinforcing means including:

(a) a faceplate mountable on the closure adjacent to the closure-engageable portion of the stop member when the closure is in closed position and the stop member is in closure-blocking position, said faceplate having a wedge-shaped projection with one face substantially parallel to the closure-engageable portion of the stop member when the closure is in closed position and the stop member is in closure-blocking position for transmitting a compressive force toward the pintle greater than the stop member swinging force transmitted during an attempt to force opening movement of the closure;

(b) a reinforcing block mountable adjacent to one of the mounting plate ears at the side thereof opposite the closure for backing abutment with such ear when force is applied to the stop member in closure-blocking position during an attempt to force opening movement of the closure; and (c) the spring means including a pigtail friction fitted between the pintle and one of the mounting plate pintle sockets for preventing inadvertent removal of the pintle from such socket.

* * * * *